United States Patent [19]

Uchida et al.

[11] 4,041,282

[45] Aug. 9, 1977

[54] LEAVES COUNTING MACHINE

[75] Inventors: Isamu Uchida, Chigasaki; Eiichi Kokubo, Urawa; Minoru Yoshida, Tokyo, all of Japan

[73] Assignee: Laurel Bank Machine Co., Ltd., Tokyo, Japan

[21] Appl. No.: 652,889

[22] Filed: Jan. 27, 1976

[30] Foreign Application Priority Data

Jan. 29, 1975 Japan ..... 50-12218

[51] Int. Cl.[2] ..... B61L 1/16

[52] U.S. Cl. ..... 235/98 R; 271/21; 271/95

[58] Field of Search ..... 235/98 R, 98 B, 98 C, 235/92 PK, 91 F; 271/21, 91, 92, 94, 95, 102, 108, 109, 110

[56] References Cited

U.S. PATENT DOCUMENTS

| | | | |
|---|---|---|---|
| 3,079,078 | 2/1963 | Halenar et al. | 235/98 |
| 3,866,828 | 2/1975 | Toung | 271/21 X |
| 3,953,022 | 4/1976 | Oshima | 271/95 |

FOREIGN PATENT DOCUMENTS

| | | | |
|---|---|---|---|
| 1,279,687 | 11/1961 | France | 235/98 R |
| 1,100,044 | 2/1961 | Germany | |
| 1,041,049 | 9/1966 | United Kingdom | 235/98 R |

*Primary Examiner*—Robert K. Schaefer
*Assistant Examiner*—Vit W. Miska

[57] ABSTRACT

A sheet separating machine comprises a rotary disc fixed on a shaft extending through a reciprocating pump and having a suction hole communicating with the pump. The pump is actuated by a vertical motion of the shaft so that the uppermost one of the sheet or leaves is sucked through suction hole onto the rotary disc. The rotary disc is provided with a sheet or leaf scraping-up piece adjacent a sector notch formed therein. The leaf scraping-up piece is inserted between the sucked leaf and the remaining leaves in the course of rotation of the rotary disc to lift up the leaf through the notch onto the rotary disc.

2 Claims, 6 Drawing Figures

LEAVES COUNTING MACHINE

This invention relates to a sheet separating novel coupling machine which counts the number of leaves or sheets of paper such as bank notes.

As the commonest means for automatically separating leaves or sheets of paper such as bank notes, there has heretofore been a leaves separating machine in which a plurality of suction tubes are disposed on the circumference of a rotary drum. The respective suction tubes revolve on their own axes and round the axis of the rotary drum. A suction port is formed in a suction face of each suction tube. Under the state under which one of the leaves is drawn by suction by means of a vacuum pump, the suction tube revolves on its own axis and round the axis of the rotary drum in predetermined amounts, whereupon the suction is released. The leaf having been drawn is interposed and held between the suction tube having drawn it and the succeeding suction tube. Thus, the leaves can be successively separated and integrated one by one.

With such sheet separating machine of the prior art, when the leaf is drawn and separated by suction, it is inevitably bent intensely, and hence, there have been involved the disadvantages that the leaf is creased and that the crease part becomes liable to tear when the leaf is separated many times.

In order to eliminate such problems, this invention intends to provide a sheet separating machine in which a leaf is drawn by suction and separated and lifted up from a bundle of leaves by the medium of a suction hole provided in a single rotary disc adapted to rotate and to vertically reciprocate, said rotary disc having a sector notch and the drawn and separated leaf is subsequently scraped up by means of a scrapingup piece mounted on the rotary disc adjacent the sector notch, whereby the leaves can be sequentially separated one by one.

An embodiment of this invention will now be described in detail with reference to the drawings.

Figure 1:
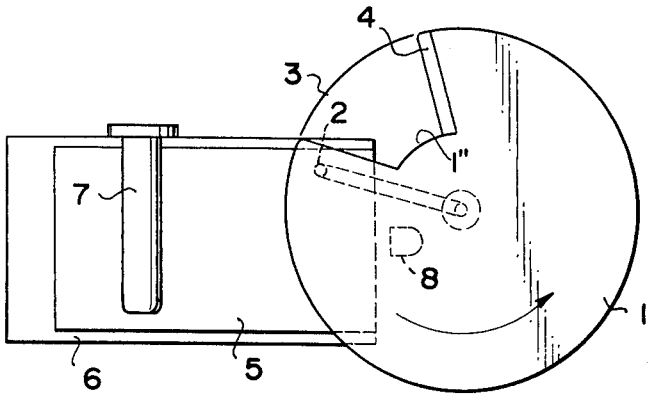
FIG. 1 is a plan view showing the essential portions of the embodiment of a sheet separating machine according to this invention.
Figure 2:
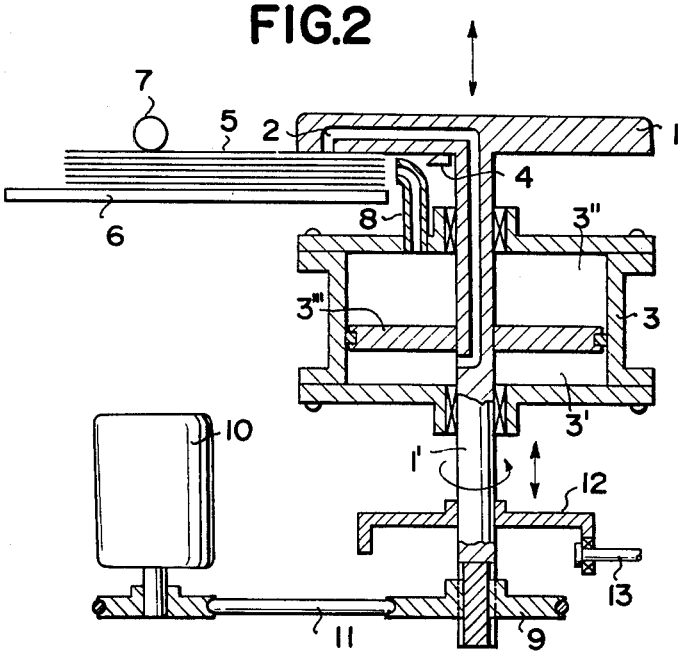
FIG. 2 is a sectional view showing the essential portions of the embodiment of the sheet separating machine according to this invention.

A rotary disc 1 comprises a shaft 1' extending through a pump 3 and is provided with a suction hole 2 communicating with the pump 3. The pump 3 has two chambers 3', 3'' defined by a reciprocating piston 3''' fixed on the shaft. The lower chamber 3' communicates through a passage in the shaft with the suction hole 2. The rotary disc 1 is endowed with a rotational motion and a vertical reciprocating motion in the illustrated directions of arrows by a rotary disc driving mechanism. The rotary disc 1 is provided with a suctor notch 1'' and a pawllike leaf scraping-up piece 4 protrudes on the lower surface of the rotary disc adjacent the notch 1''. Leaves 5 are held between a holder 6 and a keep rod 7 at a predetermined position by a leaves holding mechanism. Numeral 8 designates a blast nozzle communicating with the upper chamber 3'', which blows a blast so as to facilitate separation of the leaf 5 when the reciprocating pump ascends to draw the leaf 5 by suction.

The rotary disc 1 is so constructed that the rotational motion and the vertical reciprocating motion are made quite freely. Upon rotation of a motor 10, the pulley 9 connected to the shaft 1' by means of a spline is driven and rotated by a belt 11, so that the rotary disc 1 is rotated through transmission by the shaft 1'. Simultaneously threrewith, a vertical motion cam 12 which is fixed on the shaft of the rotary disc 1 reciprocates vertically under the control of a vertical motion control arbor 13, so that the rotary disc 1 is moved vertically and reciprocatingly. Thus, the rotary disc driving mechanism is formed.

Figure 3:
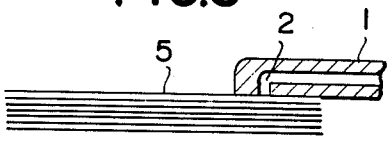
FIGS. 3 to 6 are views for elucidating the operation of the embodiment.
Figure 4:
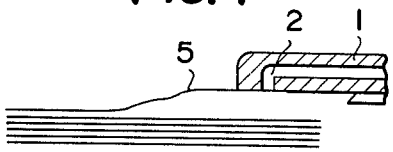
Figure 5:
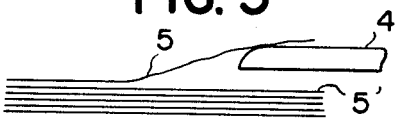
Figure 6:
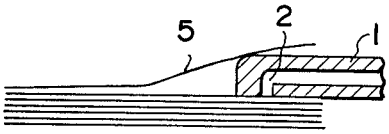

The operation of the embodiment of this invention will now be described in detail with reference to the drawings. The rotary disc 1 rotates, and the suction hole 2 comes onto the leaves 5 as illustrated in FIG. 3. Then, the rotary disc 1 ascends to draw and separate one leaf 5 by suction owing to the reciprocating piston in pump 3, so that a state of FIG. 4 is established. At this time, that blast is separated or concurrently blown against the leaf 5 by the blast nozzle 8 so as to facilitate the separation of the leaf 5. The rotary disc 1 continually rotates while drawing the leaf 5, with the result that the leaf scraping-up piece 4 is inserted between the separated leaf 5 and the remaining leaves 5' as illustrated in FIG. 5. When the leaf 5 placed on the leaf scraping-up piece 4 through the notch has been lifted up above the suction hole 2 by the rotation of the rotary disc 1, one leaf is counted. Simultaneously therewith, the rotary disc 1 has the suction of the leaf 5 completed and descends to return to the original suction position, so that a state of FIG. 6 is established. By successively repeating the above operating steps, the leaves are separated or counted one by one. Although not shown in the drawings, a counter is used to indicate the result or the number of the counted leaves.

As set forth above, according to the sheet separating machine of this invention, when the leaves are drawn and separated by suction, they are not bent and are not formed with any crease, and hence, the leaves are nor damaged. Accordingly, even when the leaves are counted, their commodity value is not degraded, and even when the leaves for use in an automatic card reader etc. are counted, quite no trouble takes place. Moreover, the sheet separating machine of this invention is much simpler in construction and more reliable in operation and can be rendered smaller in size then the sheet separating machine of the prior art, and hence, the invention has the beneficial effect that the cost can be reduced.

It is a matter of course that, as the reciprocating pump, a generally known one can be employed. Further, the counting or separating mechanism, the holding mechanism and the driving mechanism are not restricted to those of the illustrated embodiment, but all means having equivalent functions and effects shall be covered within the scope of the invention.

We claim:

1. A sheet separator machine comprising a shaft, a rotary disc fixed to the upper end of said shaft and having a suction hole and a leaf scraping-up piece, a pump positioned below said rotary disc and having a piston fixed to said shaft to define upper and lower pump chambers therein, said upper chamber communicating with said suction hole, means for rotating said shaft and its rotary disc and means for vertically reciprocating said shaft and the rotary disc during their rotation, upon upward movement of said piston by said shaft suction being produced through said suction hole due to reduction in pressure in said lower chamber of said pump.

2. A sheet separator according to claim 1 wherein said pump includes a blast nozzle communicating with said upper chamber of said pump to blow out air in the upper chamber upon upward movement of said piston.

* * * * *